US011376864B2

(12) United States Patent
Kawamoto

(10) Patent No.: US 11,376,864 B2
(45) **Date of Patent: *Jul. 5, 2022**

(54) THERMAL PRINTER AND METHOD FOR CONTROLLING THE SAME

(71) Applicant: TOSHIBA TEC KABUSHIKI KAISHA, Tokyo (JP)

(72) Inventor: Tsutomu Kawamoto, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/034,622

(22) Filed: Sep. 28, 2020

(65) Prior Publication Data

US 2021/0008893 A1 Jan. 14, 2021

Related U.S. Application Data

(63) Continuation of application No. 16/290,364, filed on Mar. 1, 2019, now Pat. No. 10,821,742.

(30) Foreign Application Priority Data

Mar. 2, 2018 (JP) ..... JP2018-037637

(51) Int. Cl.
*B41J 2/355* (2006.01)
*B41J 2/365* (2006.01)
*B41J 2/38* (2006.01)

(52) U.S. Cl.
CPC ..... *B41J 2/355* (2013.01); *B41J 2/365* (2013.01); *B41J 2/38* (2013.01)

(58) Field of Classification Search
CPC ..... B41J 2/355; B41J 2/365; B41J 2/38; B41J 2/35; B41J 2/3551; B41J 2/3553; B41J 2/3555; B41J 2/3556; B41J 2/3558
See application file for complete search history.

(56) References Cited

U.S. PATENT DOCUMENTS 5,331,340 A 7/1994 Sukigara
10,821,742 B2 * 11/2020 Kawamoto ..... B41J 2/355
2004/0233269 A1 11/2004 Tsubota

FOREIGN PATENT DOCUMENTS

DE 3833746 A1 4/1990
JP S63-004970 A 1/1988
(Continued)

OTHER PUBLICATIONS

Partial European Search Report dated Jul. 2, 2019, filed in counterpart European Patent Application No. 19160353.9, 11 pages.
(Continued)

*Primary Examiner* — Kristal Feggins
(74) *Attorney, Agent, or Firm* — Kim & Stewart LLP

(57) ABSTRACT

A thermal printer includes a thermal head, a temperature sensor, and a controller. The thermal head includes heat generation elements configured to generate heat to perform printing. The temperature sensor is disposed in the thermal printer. The controller is configured to alternately turns on and off the heat generation elements during an idle state of the thermal printer for a number of cycles with a predetermined on-time period in each cycle. The controller determines the number of cycles and the predetermined on-time period based on temperature data obtained by the temperature sensor, such that heat energy generated by the heat generation elements during each of the cycles in the idle state is lower than heat energy generated by the heat generation elements during printing of one line.

20 Claims, 3 Drawing Sheets

(B)

| TEMPERATURE RANGE No | TARGET TEMPERATURE RANGE | NUMBER OF TIMES OF ENERGIZATION | ENERGIZATION TIME ms |
|---|---|---|---|
| 1 | 0℃~-3℃ | 100 | 10% OF THAT IN NORMAL STATE |
| 2 | -3℃~-8℃ | 150 | 15% OF THAT IN NORMAL STATE |
| 3 | -8℃~-15℃ | 200 | 20% OF THAT IN NORMAL STATE |
| 4 | -15℃~-20℃ | 250 | 25% OF THAT IN NORMAL STATE |
| 5 | 0℃ | 0 | 0 |

(56) References Cited

FOREIGN PATENT DOCUMENTS

| | | | |
|---|---|---|---|
| JP | H03-289857 | A | 12/1991 |
| JP | H07-68826 | A | 3/1995 |
| JP | H08-197772 | A | 8/1996 |
| JP | H11-105329 | A | 4/1999 |
| JP | 2007-090543 | A | 4/2007 |
| JP | 2009-078482 | A | 4/2009 |

OTHER PUBLICATIONS

Japanese Notice of Reasons for Refusal dated Aug. 10, 2021 in corresponding Japanese Patent Application No. 2018-037637, 6 pages (with Translation).
Japanese Notice of Reasons for Refusal dated Jan. 17, 2022 in corresponding Japanese Patent Application No. 2018-037637, 4 pages (with Translation).

* cited by examiner (A)

(B)

| TEMPERATURE RANGE No | TARGET TEMPERATURE RANGE | NUMBER OF TIMES OF ENERGIZATION | ENERGIZATION TIME ms |
|---|---|---|---|
| 1 | 0℃~-3℃ | 100 | 10% OF THAT IN NORMAL STATE |
| 2 | -3℃~-8℃ | 150 | 15% OF THAT IN NORMAL STATE |
| 3 | -8℃~-15℃ | 200 | 20% OF THAT IN NORMAL STATE |
| 4 | -15℃~-20℃ | 250 | 25% OF THAT IN NORMAL STATE |
| 5 | 0℃ | 0 | 0 |

THERMAL PRINTER AND METHOD FOR CONTROLLING THE SAME

CROSS-REFERENCE TO RELATED APPLICATIONS

This application is continuation of U.S. patent application Ser. No. 16/290,364, filed on Mar. 1, 2019, which is based upon and claims the benefit of priority from Japanese Patent Application No. 2018-037637, filed on Mar. 2, 2018, the entire contents of each of which are incorporated herein by reference.

FIELD

Embodiments described herein relate generally to a thermal printer and a method for controlling the same.

BACKGROUND

A thermal printer applies a voltage to a plurality of heat generation elements built in a thermal head to enable the heat generation elements to generate heat, and performs printing using the generated heat. Such a printing system is called a thermal transfer system, a heat sensitive system, or the like.

An example of the thermal printer includes a receipt printer which is connected to a POS (point of sale) terminal and prints a receipt relating to a commodity registered by the POS terminal.

Recently, the thermal printer is developed for use in various situations (environment). For example, the thermal printer is used in various situations such as issuing of a label or a receipt in an outdoor event, an outdoor market, home delivery, in addition to the use in a store and a warehouse.

In such a thermal printer, it is desirable to keep constant printing quality under various use conditions by adjusting electric power applied to the heat generation element according to change in the environmental temperature, a pattern to be printed, a printing speed, and the like.

However, for example, in the thermal printer used outdoors in winter, printing instability may occur at the start of the printing. Specifically, there is a case in which the thermal head is not sufficiently heated, leading to a printing failure (for example, blurring).

A method to deal with this issue is preheating the thermal head to ensure the printing quality in a low-temperature environment. However, if the thermal head is preheated frequently, power consumption increases, which does not meet the demand for energy saving.

DETAILED DESCRIPTION

Figure 1:
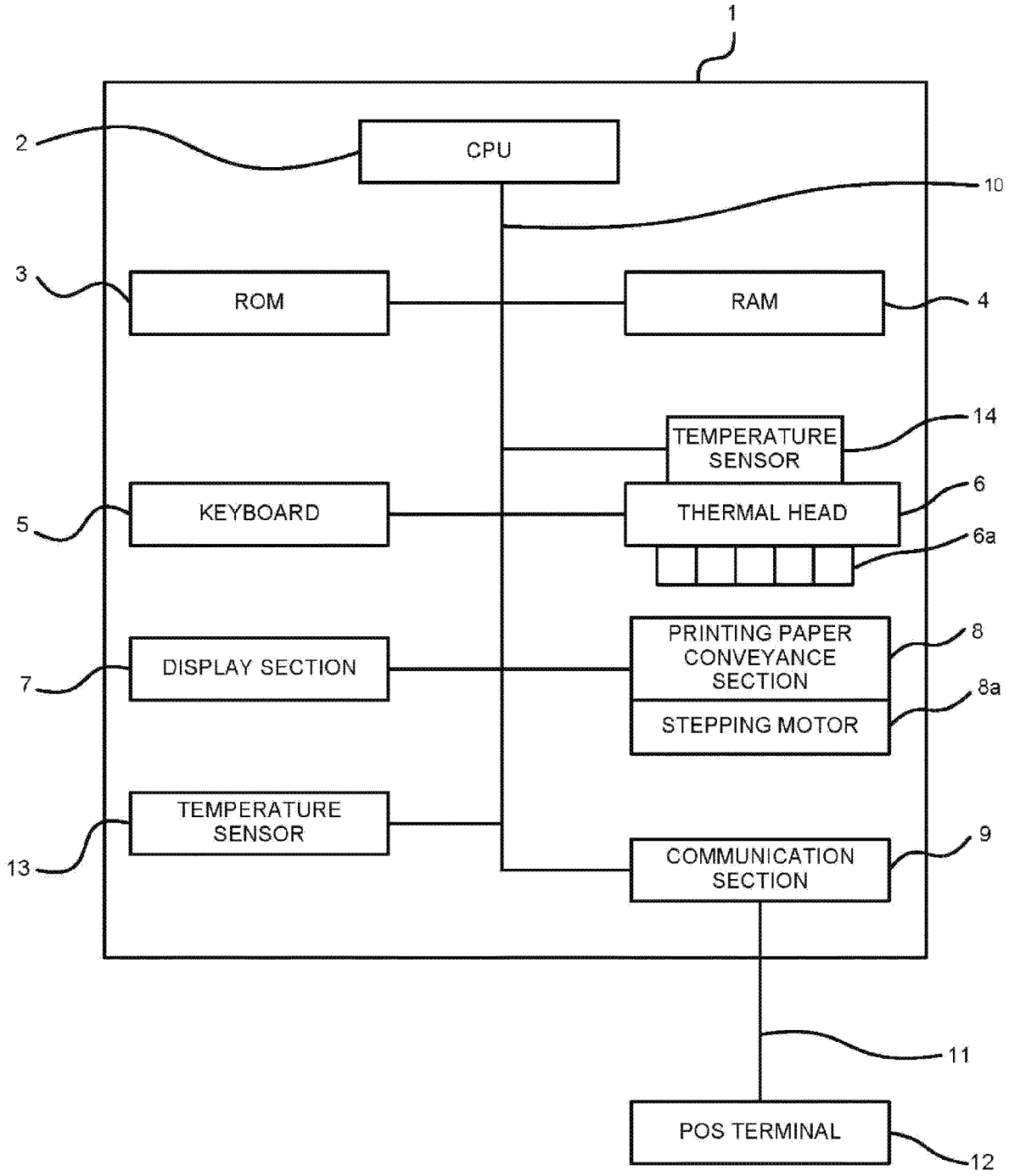
FIG. 1 is a block diagram illustrating a schematic configuration of a receipt printer according to an embodiment.

According to an embodiment, a thermal printer includes a thermal head, a temperature sensor, and a controller. The thermal head includes heat generation elements configured to generate heat to perform printing. The temperature sensor is disposed in the thermal printer. The controller is configured to alternately turns on and off the heat generation elements during an idle state of the thermal printer for a number of cycles with a predetermined on-time period in each cycle. The controller determines the number of cycles and the predetermined on-time period based on temperature data obtained by the temperature sensor, such that heat energy generated by the heat generation elements during each of the cycles in the idle state is lower than heat energy generated by the heat generation elements during printing of one line.

Hereinafter, a receipt printer according to an embodiment is described with reference to the accompanying drawings. In each drawing, the same components are denoted with the same reference numerals.

(Receipt Printer 1)

FIG. 1 is a block diagram illustrating a schematic configuration of the receipt printer 1 according to the embodiment.

The receipt printer (thermal printer) 1 includes a CPU (Central Processing Unit) 2, a ROM (Read Only Memory) 3 and a RAM (Random Access Memory) 4.

The receipt printer 1 also includes a keyboard 5, a thermal head 6, a display section 7, a printing paper conveyance section 8 and a communication section 9.

The CPU 2 controls the receipt printer 1.

The ROM 3 stores character fonts and the like. The RAM 4 has a reception buffer and a work area.

Instead of the ROM 3 and the RAM 4, an electrically rewritable ROM such as a flash memory or the like may be employed.

The keyboard 5 has a feed key and the like to receive an operation performed by a user.

The thermal head 6 has a plurality of heat generation elements 6*a* for one line, and enables the heat generation elements 6*a* to generate heat by energizing the heat generation elements 6*a*. The plurality of heat generation elements 6*a* are arranged in line along a direction orthogonal to a paper transporting direction. The thermal head 6 records on a line-by-line basis.

The display section 7 has a plurality of LEDs (Light Emitting Diodes) and the like to display an operation (printing) state of the receipt printer 1.

The printing paper conveyance section 8 has a stepping motor 8*a* and the like to convey (feed) a printing paper (thermal paper) towards the thermal head 6, and conveys (discharges) the printing paper after printing. The stepping motor 8*a*, for example, rotates the platen roller opposed to the thermal head 6. The stepping motor 8*a* is driven and controlled by a driver that issues a drive signal in accordance with a pulse input of a motor step. At the time of printing, the pulse input of the motor step is performed for each line printing time.

The communication section 9 is connected to the CPU 2 via a bus line 10.

The communication section 9 is connected to a POS terminal 12 via a communication line 11.

The POS terminal 12 transmits print data to the receipt printer 1. Then, the CPU 2 selectively enables the heat generation elements 6*a* to generate heat according to the print data, and prints characters or the like on the printing paper.

When no print data is input from the POS terminal 12, the CPU 2 changes the state of the receipt printer 1 to an idle state (print job waiting state) in which power consumption is suppressed.

The receipt printer 1 includes two temperature sensors 13 and 14.

The temperature sensor 13 measures an internal temperature of the receipt printer 1, and is disposed in a housing of the receipt printer 1.

The temperature sensor 14 measures a temperature of the heat generation elements 6*a* and is disposed in the thermal head 6.

The measurement data of the temperature sensors 13 and 14 is transmitted to the CPU 2.

The CPU 2 periodically acquires the measurement data of the temperature sensor 13 to monitor the internal temperature of the receipt printer 1. For example, if the internal temperature of the receipt printer 1 exceeds a predetermined temperature (for example, 70 degrees centigrade), the CPU 2 can stop the receipt printer 1.

Similarly, the CPU 2 periodically acquires the measurement data of the temperature sensor 14 to monitor the temperature of the heat generation elements 6*a*. For example, the CPU 2 can stop the receipt printer 1 if the temperature of the thermal head 6 exceeds a predetermined temperature.

The CPU (head preheat processing section, motor preliminary driving processing section) 2 preheats the thermal head 6 and the stepping motor 8*a* based on the measurement data of the temperature sensor 13 when the receipt printer 1 is in the idle state.

(Preheat Processing)

Next, the preheat processing (control method) of the receipt printer 1 is described.

Figure 2:
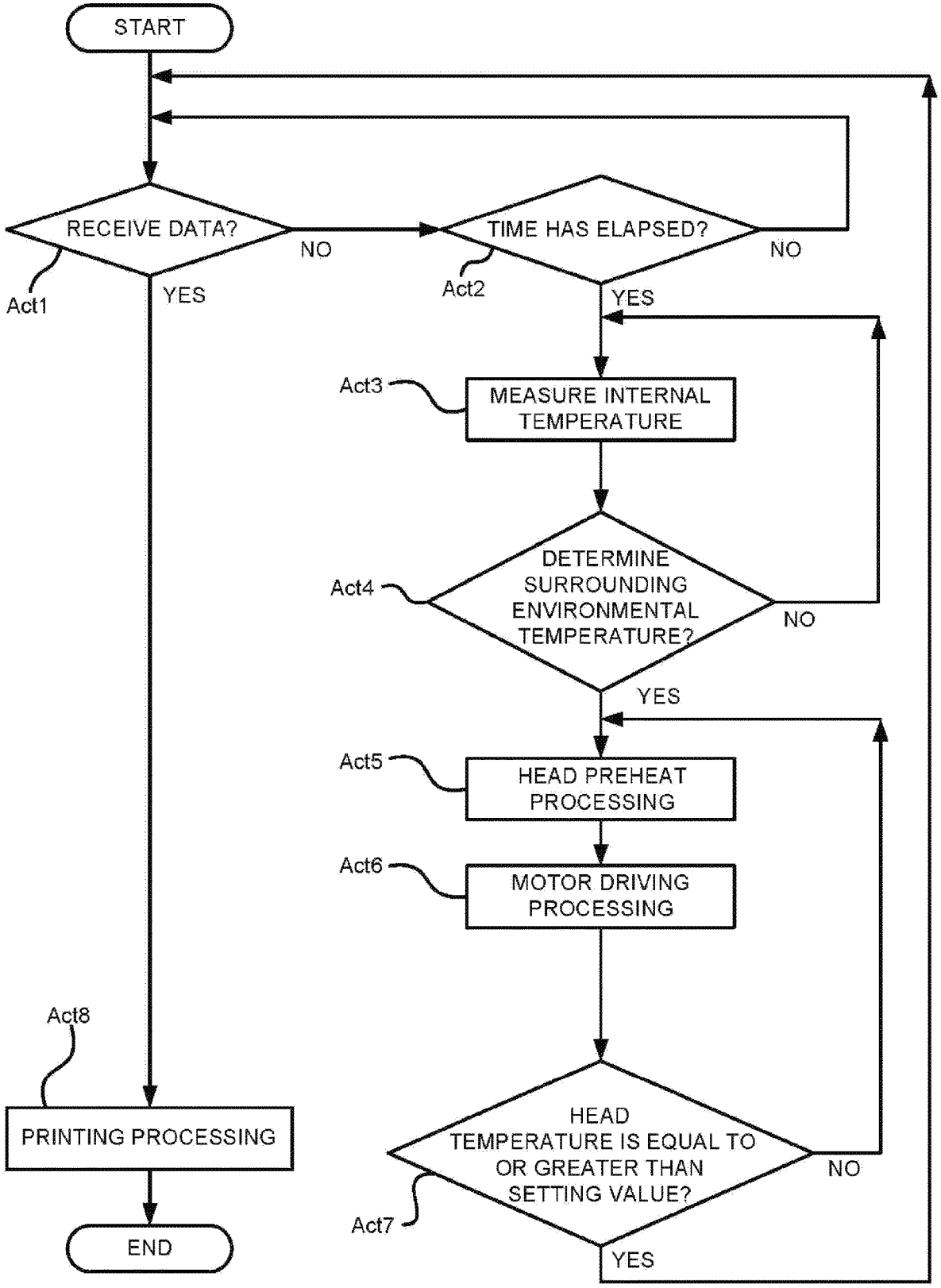
FIG. 2 is a flowchart depicting a preheat processing executed by the receipt printer.

FIG. 2 is a flowchart depicting the preheat processing executed by the receipt printer 1.

Figure 3:
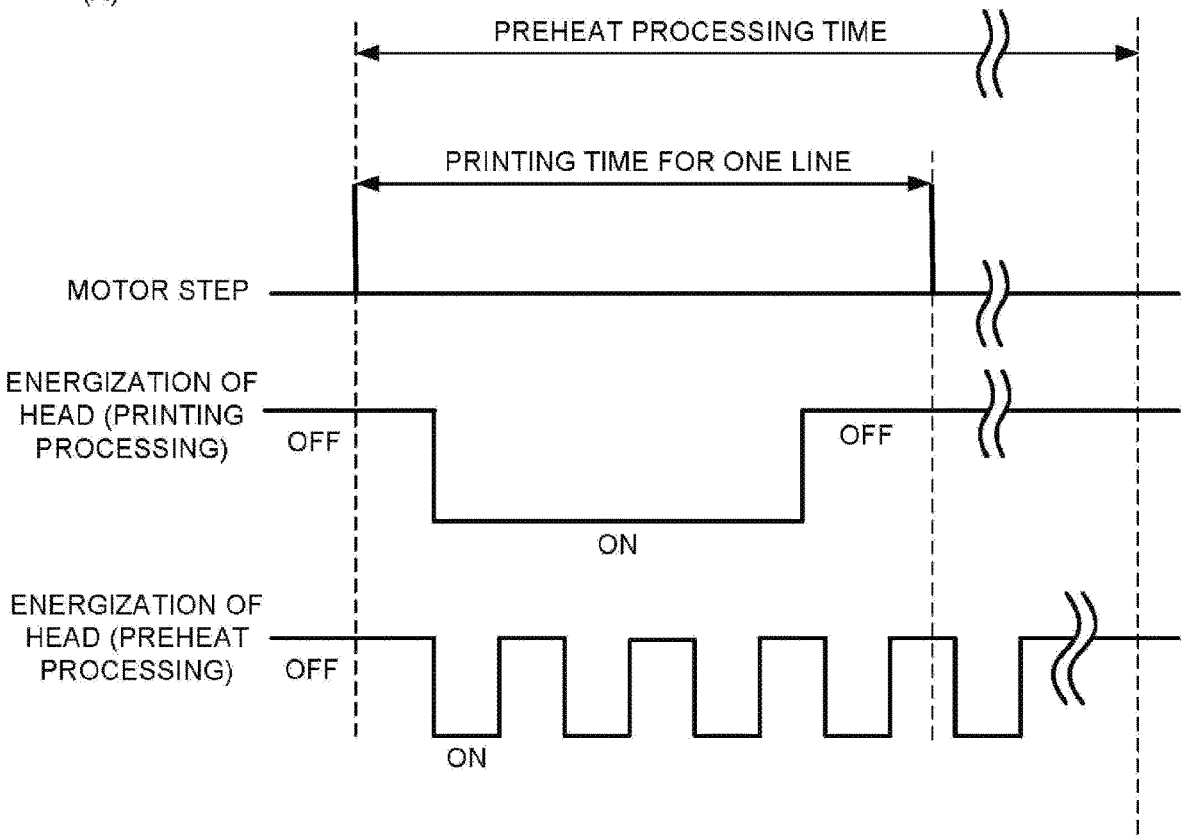
FIG. 3 is a diagram illustrating the preheat processing executed by the receipt printer, in which (A) shows a timing chart for an energization time of heat generation elements and (B) shows a setting table in which the energization time and number of times of energization of the heat generation elements are defined.

FIG. 3 is a diagram illustrating the preheat processing executed by the receipt printer 1, in which (A) shows a timing chart for an energization time of the heat generation elements 6*a* and (B) shows a setting table in which the energization time and the number of times of energization of the heat generation elements 6*a* are defined.

The CPU 2 constantly determines whether or not the print data is received from the POS terminal 12 (Act 1). If no print data is received, the determination is repeated until the print data is received.

Next, if no print data is received even after a predetermined time elapses, the CPU 2 changes the state of the receipt printer 1 to the idle state (Act 2). Specifically, the receipt printer 1 enters the idle state if no print data is received even after elapse of 10 minutes since the last print data is received, for example.

(Temperature Measurement Processing)

If the receipt printer 1 enters the idle state, the CPU periodically acquires the measurement data of the temperature sensor 13 (Act 3). For example, the measurement data of the temperature sensor 13 is acquired every 10 minutes.

Then, the CPU 2 determines the surrounding temperature (surrounding environmental temperature) of the receipt printer 1 based on the measurement data in five times (Act 4). If the idle state continues for several tens of minutes or more, the internal temperature of the receipt printer 1 becomes substantially equal to the surrounding environmental temperature. Therefore, the CPU 2 determines an average value of the measurement data in five times as the surrounding environmental temperature, for example.

The surrounding environmental temperature is stored in the RAM 4. The surrounding environmental temperature stored in the RAM 4 is updated if the next measurement data is acquired and the latest surrounding environmental temperature is determined.

A surrounding environmental temperature setting processing (Act 3 and Act 4) is continuously executed until the idle state is terminated.

(Head Preheat Processing Step)

Next, the CPU 2 enables the heat generation elements 6*a* to generate heat based on the surrounding environmental temperature to preheat the thermal head 6 (Act 5).

At this time, the temperature of the heat generation elements 6*a* is set to a temperature at which the printing paper does not develop color. The heat generation elements 6*a* are enabled to generate heat by being energized at lower energy than that at the time of printing.

Specifically, as shown in FIG. 3(A), the heat generation elements 6*a* are enabled to generate heat by setting an energization time of the heat generation elements 6*a* shorter than that at the time of printing. Specifically, the energization time of the heat generation elements 6*a* is set to be shorter than that when the printing paper develops color. The energization time of the thermal head 6 is set stepwise according to the surrounding environmental temperature as described below.

The heat generation elements 6*a* are energized a plurality of times (the number of times of energization). Specifically, preheating of the heat generation elements 6*a* are repeated at a certain interval. The number of times of energization of the thermal head 6 is also set stepwise according to the surrounding environmental temperature as described below.

In the preheat processing of the thermal head 6, the energy (power*time: Wh) supplied to the heat generation elements 6*a* is lower than that at the time of printing. The applied electric power in the preheat processing may be the same as or different from that at the time of printing. By adjusting the energization time and the number of times of energization, the energy supplied to the heat generation elements 6*a* is lower than that at the time of printing.

In the preheat processing of the thermal head 6, the preheating of the thermal head 6 may enable all of the plurality of the heat generation elements 6*a* to generate heat, or may enable any heat generation element 6*a* to generate heat. Even when all of the plural heat generation elements 6*a* are heated, for example, the adjacent heat generation elements 6*a* may be enabled to alternately generate heat.

As shown in FIG. 3 (B), in the preheat processing of the thermal head 6, the energization time and the number of times of energization of the heat generation element 6*a* are set stepwise according to the surrounding environmental temperature. As the surrounding environmental temperature decreases, the energization time and the number of times of energization of the heat generation elements 6*a* increase.

When the surrounding environmental temperature is in a range of No. 1 (0° C. to −3° C.), the energization time is set to 10% of that in a normal state, and the number of times of energization is set to 100.

When the surrounding environmental temperature is in a range of No. 2 (−3° C. to −8° C.), the energization time is set to 15% of that in the normal state, and the number of times of energization is set to 150.

When the surrounding environmental temperature is in a range of No. 3 (−8° C. to −15° C.), the energization time is set to 20% of that in the normal state, and the number of times of energization is set to 200.

When the surrounding environmental temperature is in a range of No. 4 (−15° C. to −20° C.), the energization time is set to 25% of that in the normal state, and the number of times of energization is set to 250.

When the surrounding environmental temperature is in a range of No. 5 (0° C. or more), the energization time is set to 0 ms, and the number of times of energization is set to 0.

The setting table in FIG. 3(B) is stored in the ROM. Then, a temperature range width and the number of temperature ranges of each surrounding environmental temperature in the setting table may be appropriately changed. The energization time and the number of times of energization of the heat generation elements 6*a* may be changed as appropriate as well.

(Motor Preliminary Driving Processing Step)

In the stepping motor 8*a*, a starting torque decreases and a viscosity of a bearing grease increases under the low-temperature environment, resulting in deterioration in the motor characteristics. As a result, the printing quality of the receipt printer 1 deteriorates.

Therefore, the CPU 2 preheats the printing paper conveyance section 8 at the same time as the preheat processing of the thermal head 6. Specifically, a stepping motor 8*a* is driven to reciprocate (Act 6).

For example, an operation of moving the stepping motor 8*a* by one step in a negative direction after moving the stepping motor 8*a* by one step in a positive direction is performed a plurality of times. Specifically, the printing paper conveyance section 8 is controlled to enable the printing paper to repeatedly reciprocate.

By continuously driving the stepping motor 8*a*, the motor characteristics are maintained even under the low-temperature environment. Since the stepping motor 8*a* is reciprocally driven, the printing paper is not wastefully discharged (conveyed).

The motor preliminary driving processing (Act 6) is continuously executed until the head preheat processing (Act 5) is terminated.

If the preheat processing of the thermal head 6 is started, the CPU 2 acquires the measurement data of the temperature sensor 14 to determine whether or not the temperature of the thermal head 6 exceeds 0° C. (Act 7).

In Act 7, if the temperature of the thermal head 6 is equal to or lower than 0° C., the preheat processing of the thermal head 6 is continuously executed.

If the preheat processing of the thermal head 6 is terminated, the CPU 2 again performs the preheat processing (Act 5) of the thermal head 6 and the motor preliminary driving processing (Act 6).

At this time, the CPU 2 refers to the surrounding environmental temperature (Act 4) stored in the RAM 4 again. Then, based on the surrounding environmental temperature stored in the RAM 4, the energization time and the number of times of energization of the heat generation elements 6*a* are set. In other words, according to the change in the surrounding environmental temperature, contents of the preheat processing of the thermal head 6 (including the energization time and the number of times of energization of the heat generation elements 6*a*) are changed.

In Act 7, if the temperature of the thermal head 6 exceeds 0° C., the CPU 2 terminates the preheat processing of the thermal head 6. In other words, the CPU 2 repeatedly performs the preheat processing (Act 5) and the motor preliminary driving processing (Act 6) until the temperature of the thermal head 6 exceeds 0° C.

Returning to Act 1, if the print data is received, the CPU 2 cancels the idle state to execute a printing processing (Act 8).

Specifically, the stepping motor 8*a* is moved by several steps, and the thermal head 6 is driven by one line to perform printing for one line. The heat generation elements 6*a* for of one line is selectively applied based on printing data. Whether or not all the print data is output is determined, and if the printing is not terminated, the above printing operation is repeated on a line-by-line basis.

If the printing is terminated, the printing paper after printing is discharged, and the printing processing is terminated.

When the receipt printer 1 returns from the idle state to execute the printing processing, the temperature of the thermal head 6 is preheated to a temperature exceeding 0° C. Therefore, it is possible to ensure the printing quality. Specifically, when the CPU 2 is in the idle state, since the heat generation elements 6*a* are preheated by energization a plurality of times in a shorter time than that at the time of printing, the printing is not performed and the printing paper is not wasted.

If the preheat processing of the thermal head 6 is repeatedly executed, the energization time and the number of times of energization of the heat generation elements 6*a* are set based on the surrounding environmental temperature stored in the RAM 4 each time the preheat processing is executed. In this manner, the receipt printer 1 variably preheats the thermal head 6 according to the surrounding environmental temperature, and in this way, it is possible to ensure the printing quality under the low-temperature environment while suppressing the power consumption.

Since the surrounding environmental temperature is determined based on the temperature data measured by the temperature sensor 13 a plurality of times, it is possible to accurately reflect the change in the actual surrounding environmental temperature.

At the time of preheating the thermal head 6, the receipt printer 1 also synchronously carries out the motor preliminary driving processing for driving the stepping motor 8*a* of the printing paper conveyance section 8. Therefore, even under the low-temperature environment, it is possible to prevent a decrease in the starting torque of the stepping motor 8*a* and an increase in viscosity of the bearing grease. Therefore, even under the low-temperature environment, the printing paper is conveyed accurately, and the printing quality of the receipt printer 1 can be maintained.

Specifically, since the stepping motor 8*a* is repeatedly reciprocally rotated, the printing paper is not wasted.

In the above-described embodiment, the receipt printer 1 is described as an example of the thermal printer, but it is not limited thereto. The thermal printer may be a label printer or the like.

In the above-described embodiment, the surrounding environmental temperature is determined based on the measurement data of the temperature sensor 13 that measures the internal temperature of the receipt printer 1, but it is not limited thereto. A dedicated temperature sensor for measuring the surrounding environmental temperature may be provided at the outside of the receipt printer 1.

In the above-described embodiment, the head preheat processing and the motor preliminary driving processing are performed at the same time, but it is not limited thereto. For example, the head preheat processing and the motor preliminary driving processing may be alternately performed. For example, a dedicated temperature sensor for measuring the temperature of the stepping motor 8*a* may be provided, and the motor preliminary driving processing may be executed according to the measurement data of the temperature sensor.

In the embodiment described above, the POS terminal 12 is described as an example of a host device, but it is not limited thereto. The host device may be a personal computer or a handy terminal that can be connected to the receipt printer 1.

In the motor preliminary driving processing, only the stepping motor 8*a* may be energized. In other words, the stepping motor 8*a* may not be rotated. This is because a coil of the stepping motor 8*a* can be preheated only by energizing the stepping motor 8*a*.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal printer comprising:

a thermal head including heat generation elements configured to generate heat to perform printing;

a temperature sensor disposed in the thermal printer;

a sheet conveyor including a motor configured to rotate to convey a sheet toward the thermal head; and a controller configured to alternately turn on and off the heat generation elements during an idle state of the thermal printer for a number of cycles with a predetermined on-time period in each cycle and energize the motor during the idle state, wherein the controller determines the number of cycles and the predetermined on-time period based on temperature data obtained by the temperature sensor, such that heat energy generated by the heat generation elements during each of the cycles in the idle state is lower than heat energy generated by the heat generation elements during printing of one line.

2. The thermal printer according to claim 1, wherein the controller causes the motor to reciprocally rotate a plurality of times during the idle state by energizing the motor.

3. The thermal printer according to claim 1, wherein the controller is configured to stop alternate turn-on and turn-off of the heat generation elements and energization of the motor when the idle state ends.

4. The thermal printer according to claim 1, wherein the controller is configured to carry out the alternate turn-on and turn-off of the heat generation elements and the energization of the motor simultaneously at least part of the time during the idle state of the thermal printer.

5. The thermal printer according to claim 1, wherein the controller is further configured to determine a surrounding environmental temperature based on the temperature data, and determine the number of cycles and the predetermined on-time period based on the surrounding environmental temperature.

6. The thermal printer according to claim 5, wherein the controller determines the surrounding environmental temperature based on the temperature data obtained by the temperature sensor a multiple number of times.

7. The thermal printer according to claim 6, wherein when the surrounding environmental temperature is a first temperature, the controller determines the number of cycles to be a first number of cycles, and the predetermined on-time period to be a first time period, and when the surrounding environmental temperature is a second temperature lower than the first temperature, the controller determines the number of cycles to be a second number of cycles greater than the first number of cycles, and the predetermined on-time period to be a second time period longer than the first time period.

8. The thermal printer according to claim 6, wherein when the surrounding environmental temperature is in a first temperature range, the controller determines the number of cycles to be a first number of cycles, and the predetermined on-time period to be a first time period, and when the surrounding environmental temperature is in a second temperature range that is lower than the first temperature range and does not overlap the first temperature range, the controller determines the number of cycles to be a second number of cycles greater than the first number of cycles, and the predetermined on-time period to be a second time period longer than the first time period.

9. The thermal printer according to claim 1, wherein the controller is further configured to cause the thermal printer to enter the idle state when a period of time during which no print data is received exceeds a threshold.

10. The thermal printer according to claim 1, wherein the controller is further configured to determine a temperature of the thermal head based on temperature data obtained by the temperature sensor, and cause the thermal printer to end the idle state when the temperature of the thermal head is higher than a threshold.

11. A method for controlling a thermal printer comprising a thermal head including a heat generation elements configured to generate heat to perform printing and a sheet conveyor including a motor configured to rotate to convey a sheet toward the thermal head, the method comprising, during an idle state of the thermal printer:

measuring a temperature around the thermal head;

energizing the motor; and alternately turning on and off the heat generation elements for a number of cycles with a predetermined on-time period in each cycle based on the measured temperature, such that heat energy generated by the heat generation elements during each of the cycles in the idle state is lower than heat energy generated by the heat generation elements during printing of one line.

12. The method according to claim 11, wherein said energizing the motor during the idle state comprises causing the motor to reciprocally rotate a plurality of times during the idle state.

13. The method according to claim 11, further comprising:

stopping alternate turn-on and turn-off of the heat generation elements and energization of the motor when the idle state ends.

14. The method according to claim 11, wherein alternate turn-on and turn-off of the heat generation elements and energization of the motor are carried out simultaneously at least part of the time during the idle state of the thermal printer.

15. The method according to claim 11, further comprising, during the idle state of the thermal printer:

determining a surrounding environmental temperature based on the measured temperature; and determining the number of cycles and the predetermined on-time period based on the surrounding environmental temperature.

16. The method according to claim 15, wherein the surrounding environmental temperature is determined based on a plurality of measured temperatures obtained during the idle state of the thermal printer.

17. The method according to claim 16, wherein said determining the number of cycles and the predetermined on-time period based on the surrounding environmental temperature comprises:

when the surrounding environmental temperature is a first temperature, determining the number of cycles to be a first number of cycles, and the predetermined on-time period to be a first time period; and when the surrounding environmental temperature is a second temperature lower than the first temperature, determining the number of cycles to be a second number of cycles greater than the first number of cycles, and the predetermined on-time period to be a second time period longer than the first time period.

18. The method according to claim 16, wherein said determining the number of cycles and the predetermined on-time period based on the surrounding environmental temperature comprises:

when the surrounding environmental temperature is in a first temperature range, determining the number of cycles to be a first number of cycles, and the predetermined on-time period to be a first time period; and when the surrounding environmental temperature is in a second temperature range that is lower than the first temperature range and does not overlap the first temperature range, determining the number of cycles to be a second number of cycles greater than the first number of cycles, and the predetermined on-time period to be a second time period longer than the first time period.

19. The method according to claim 11, further comprising:

causing the thermal printer to enter the idle state when a period of time during which no print data is received exceeds a threshold.

20. The method according to claim 11, further comprising, during the idle state of the thermal printer:

determining a temperature of the thermal head based on temperature data obtained by the temperature sensor; and causing the thermal printer to end the idle state when the temperature of the thermal head is higher than a threshold.

* * * * *